US005487400A

United States Patent [19]

Dawkins

[11] Patent Number: 5,487,400

[45] Date of Patent: Jan. 30, 1996

[54] SELF-INFLATING TENTS

[76] Inventor: Katherine J. Dawkins, #1-168 Indian Rd Cres, Toronto, Ontario, Canada, M6P 2G3

[21] Appl. No.: 212,050

[22] Filed: Mar. 14, 1994

[51] Int. Cl.[6] ..... E04B 1/34

[52] U.S. Cl. ..... 135/87; 135/97; 135/128; 135/124; 52/2.11; 52/2.22

[58] Field of Search ..... 52/2.11, 2.17, 52/2.19, 2.22; 135/115, 119, 904, 905, 906, 908, 97, 87, 128, 126, 116, 124

[56] References Cited

U.S. PATENT DOCUMENTS

| | | | |
|---|---|---|---|
| 2,830,606 | 4/1958 | Daugherty | 52/2.19 |
| 3,999,333 | 12/1976 | Amarantos | 52/2.19 |
| 4,000,585 | 1/1977 | Denaro | 52/2 |
| 4,000,749 | 1/1977 | Busco | 52/2.17 X |
| 4,031,674 | 6/1977 | Rand | 52/2 |
| 4,295,302 | 10/1981 | Liu | 52/2 |
| 4,335,545 | 6/1982 | Couch | 52/2.19 |
| 4,384,435 | 5/1983 | Polise et al. | 52/2.19 |
| 4,766,918 | 8/1988 | Odekirk | 52/2.19 X |
| 4,819,389 | 4/1989 | Kihn | 52/2 |
| 5,115,525 | 5/1992 | Lovitt | 5/449 X |
| 5,226,261 | 7/1993 | Wilbourn et al. | 52/2.22 X |

FOREIGN PATENT DOCUMENTS

| | | | |
|---|---|---|---|
| 4231563 | 8/1992 | Japan | 52/2.11 |

*Primary Examiner*—Wynn E. Wood

[57] ABSTRACT

A self-inflating tent comprising a mattress formed of a sheet in a planar configuration; a raised shaped tent having a lower peripheral edge secured to the mattress adjacent to its periphery but inboard thereof to provide a flange at the outer most periphery to constitute a ground rim; the material of the tent and mattress being fabricated of an open cell polyurethane, each with an exterior and interior liner of an air impervious flexible plastic; a first valve coupled to the tent to allow the flow of air into the tent material and to allow exiting of air therefrom when the tent material is compressed when the valve is opened; and a second valve coupled to the mattress to allow the flow of air into the mattress material and to allow exiting of air therefrom when the mattress material is compressed and the valve is opened.

1 Claim, 3 Drawing Sheets

FIG. 5
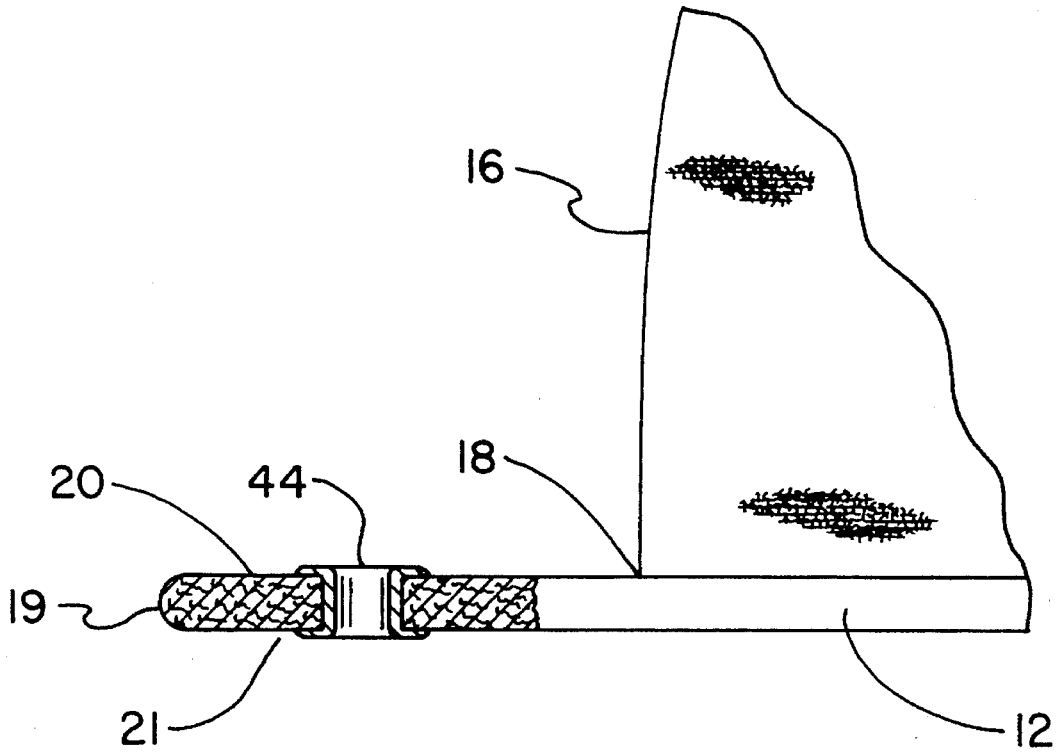
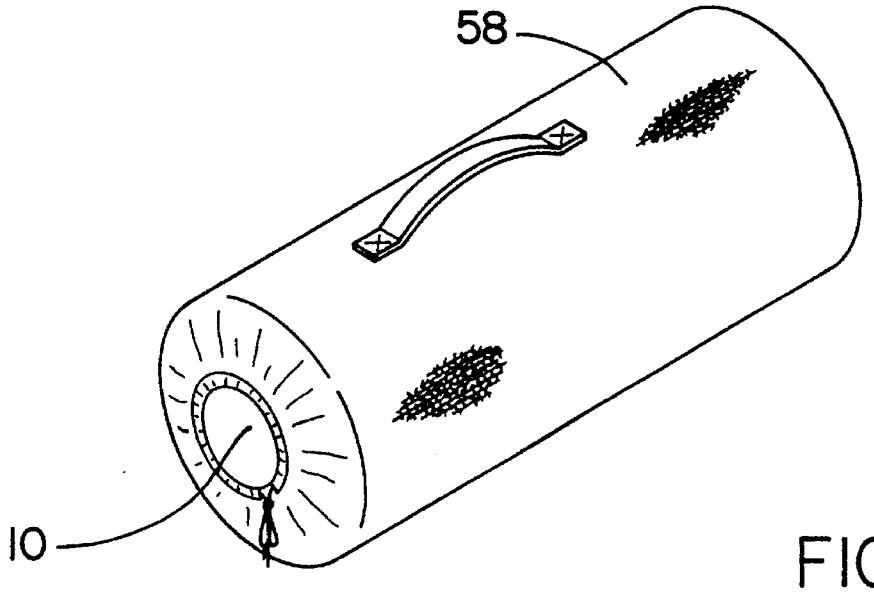
FIG. 6

SELF-INFLATING TENTS

BACKGROUND OF THE INVENTION

1. Field of the Invention

The present invention relates to new and improved self-inflating tent and more particularly pertains to inflating tent structures automatically through the simple opening of a valve.

2. Description of the Prior Art

The use of inflatable tents is known in the prior art. More specifically, inflatable tents heretofore devised and utilized for the purpose of providing shelter through the inflation of the tent are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,819,389 to Kihn discloses an inflatable tent.

U.S. Pat. Nos. 4,031,674 to Rand, 4,295,302 to Lui and 4,384,435 to Polixe disclose an inflatable tent.

U.S. Pat. No. 4,000,585 to Denaro discloses an inflatable collapsible tent.

In this respect, the self-inflating tents according to the present invention substantially departs from the conventional concepts and designs of the prior art, and in doing so provides an apparatus primarily developed for the purpose of inflating tent structures automatically through the simple opening of a valve.

Therefore, it can be appreciated that there exists a continuing need for new and improved self-inflating tents which can be used for inflating tent structures automatically through the simple opening of a valve. In this regard, the present invention substantially fulfills this need.

SUMMARY OF THE INVENTION

In view of the foregoing disadvantages inherent in the known types of inflatable tents now present in the prior art, the present invention provides an improved self-inflating tents. As such, the general purpose of the present invention, which will be described subsequently in greater detail, is to provide a new and improved self-inflating tents and method which has all the advantages of the prior art and none of the disadvantages.

To attain this, the present invention essentially comprises a new and improved self-inflating tent comprising, in combination, a mattress formed of a flat sheet in a circular configuration; a dome shaped tent having a lower peripheral edge secured to the mattress adjacent to its periphery but inboard thereof to provide a flange at the outer most periphery to constitute a ground rim; the material of the tent and mattress being fabricated of an open cell polyurethane each with an exterior and interior liner of an air impervious flexible plastic; a first valve coupled to the tent to allow the flow of air into the tent material and to allow exiting of air therefrom when the tent material is compressed when the valve is opened; a second valve coupled to the mattress to allow the flow of air into the mattress material and to allow exiting of air therefrom when the mattress material is compressed and the valve is opened; a plurality of grommets extending through the periphery of the mattress in the ground rim for securement of the ground rim, mattress and tent to a predetermined location; apertures formed in the tent for functioning as windows and doors and having closure windows and doors to selectively seal the apertures; and a carrying bag for receiving the tent and mattress when in a collapsed and folded orientation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved self-inflating tents which have all the advantages of the prior art inflatable tents and none of the disadvantages.

It is another object of the present invention to provide new and improved self-inflating tents which may be easily and efficiently manufactured and marketed.

It is further object of the present invention to provide new and improved self-inflating tents which are of durable and reliable constructions.

An even further object of the present invention is to provide new and improved self-inflating tents which are susceptible of a low cost of manufacture with regard to both materials and labor, and which accordingly are then susceptible of low prices of sale to the consuming public, thereby making such self-inflating tents economically available to the buying public.

Still yet another object of the present invention is to provide new and improved self-inflating tents which provide in the apparatuses and methods of the prior art some of the advantages thereof, while simultaneously overcoming some of the disadvantages normally associated therewith.

Still another object of the present invention is to inflate tent structures automatically through the simple opening of a valve.

Lastly, it is an object of the present invention to provide new and improved a self-inflating tent comprising a mattress formed of a sheet in a planar configuration; a raised shaped tent having a lower peripheral edge secured to the mattress adjacent to its periphery but inboard thereof to provide a flange at the outer most periphery to constitute a ground rim; the material of the tent and mattress being fabricated of an open cell polyurethane, each with an exterior and interior liner of an air impervious flexible plastic; a first valve coupled to the tent to allow the flow of air into the tent material and to allow exiting of air therefrom when the tent material is compressed when the valve is opened; and a second valve coupled to the mattress to allow the flow of air into the mattress material and to allow exiting of air therefrom when the mattress material is compressed and the valve is opened.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a cross sectional view of the periphery of the ground rim.

FIG. 6 is an alternate embodiment of the invention illustrating the tent of the prior Figures collapsed and stored in a carrying bag.

The same reference numerals refer to the same parts through the various Figures.

DESCRIPTION OF THE PREFERRED EMBODIMENT

Figure 1:
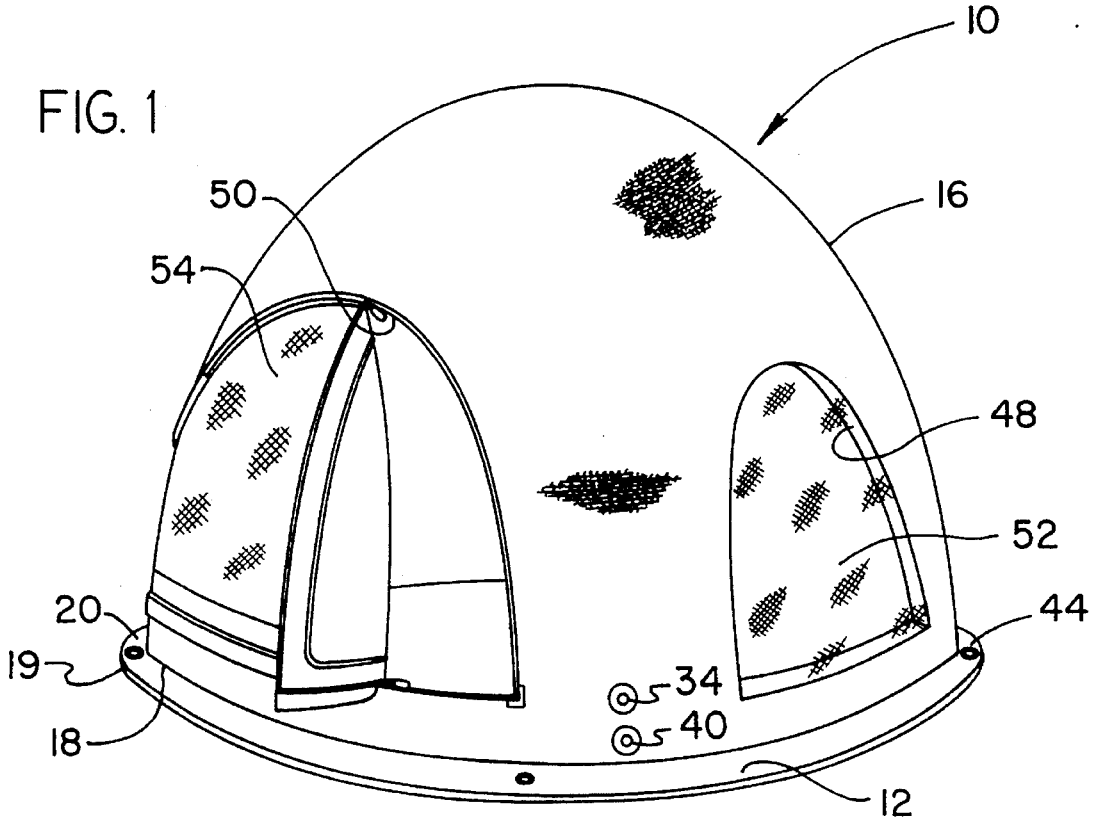
FIG. 1 is a perspective view of the preferred embodiment of the new and improved self-inflating tent constructed in accordance with the principles of the present invention.

With reference now to the drawings, and in particular to FIG. 1 thereof, the preferred embodiment of the new and improved self-inflating tent embodying the principles and concepts of the present invention and generally designated by the reference numeral 10 will be described.

Specifically, the present invention, the new and improved self-inflating tent is comprised of a plurality of individual components. In their broadest context, such components include a mattress, a tent, material for the tent and mattress, a first valve, a second valve, grommets, apertures and the carrying bag. Each of the components is specifically configured individually and correlated with respect to each other in order to attain the desired objectives.

More specifically, the tent of the present invention has at its base a mattress 12. The mattress is formed of flat sheet in a circular configuration. Note FIGS. 1 and 2. The mattress and tent are of a size, configuration and material so that a person in the tent may stand, walk, sit, or even sleep comfortably on the mattress.

Figure 2:
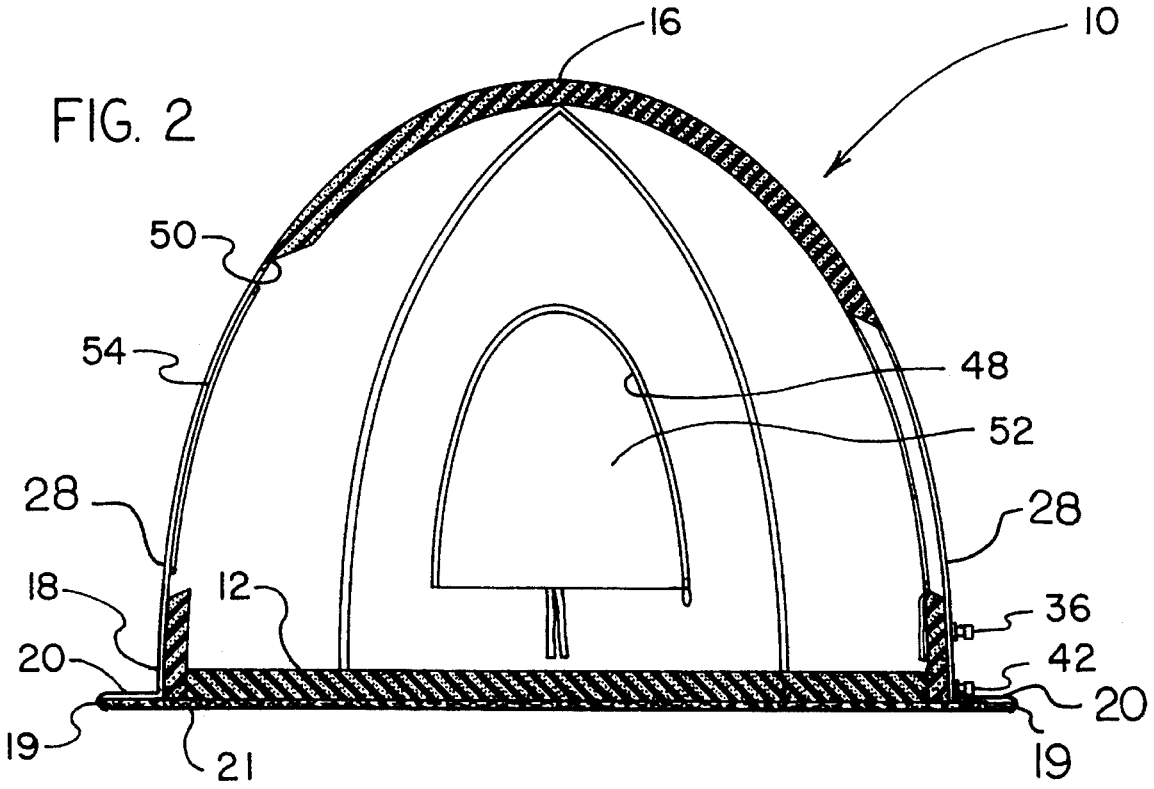
FIG. 2 is a cross sectional view taken vertically through the center of the tent of FIG. 1.
Figure 3:
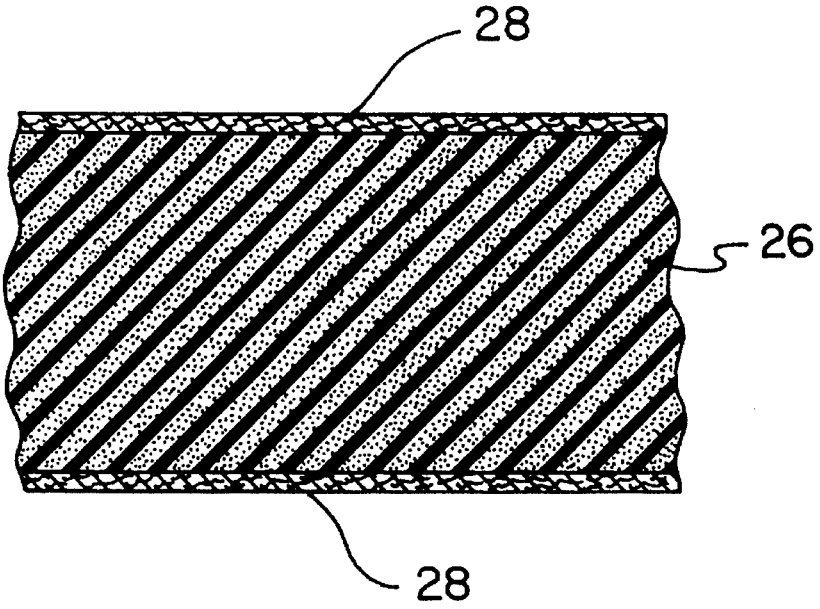
FIG. 3 is a cross sectional view of the body portion of the tent shown in FIGS. 1 and 2.
Figure 4:
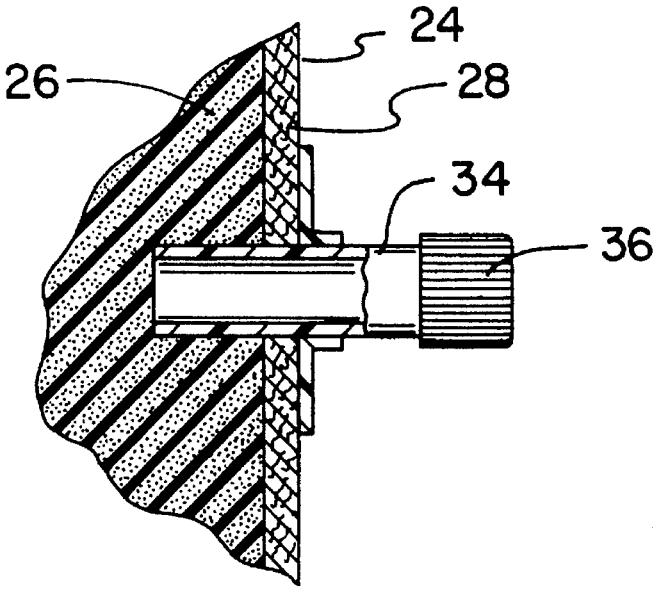
FIG. 4 is a sectional view illustrating the valve for the inflation of the tent of the prior Figures.

The next component of the tent is a dome shaped member 16. The tent has a lower peripheral edge 18. Such edge is secured to the mattress adjacent to its periphery. It is preferably located a small distance inboard of the peripheral edge of the mattress. In this manner, there is provided a flange 20 at the outermost periphery which constitutes a ground rim 19. As shown in FIGS. 2 and 5, the mattress has an upper component at the lower end of the dome shaped member 16 and, secured to the bottom thereof, a larger circular sheet 21 of a slightly larger diameter.

The dome shaped tent is the preferred embodiment of the invention. It should be understood that other configurations could readily be utilized. Another alternate design is a semi-cylindrical member with an opening at both ends. In such case, the mattress would be of a rectangular configuration.

In the preferred embodiment, the material 24 of the tent and the material 26 of the mattress are preferably the same. The preferred material for fabricating the tent and mattress is an open cell polyurethane. The material of the tent and mattress are individually provided with an exterior liner 28 and an interior liner 30. The liner material is preferably of an air and water impervious flexible plastic, preferably nylon. Such liner is secured as by stitching and heat sealing around its periphery to totally encase the open cell material therewithin.

Coupled to the tent at one location, preferably at a lower extent, is a first valve 34. The first valve has a cap 36 for opening and closing the valve for the flow of air therethrough. The first valve functions to allow the flow of air from atmosphere into the tent material. It also functions to allow exiting of the air from the tent material when the tent material is compressed and when the valve is opened.

Also provided at an area, preferably adjacent to the first valve, is a second valve 40. The second valve has a cap 42 and passes through the lower periphery edge of 18 of the dome shaped tent 16 to couple to the mattress material. The second valve functions to allow the flow of air into the mattress material. It also functions to allow exiting of air therefrom when the mattress material is compressed and the second valve is opened.

Another feature of the invention is a plurality of grommets 44. The grommets are positioned to extend through the periphery of the mattress in the ground rim. The grommets are for use with pins, tent stakes or the like for the securement of the ground rim, mattress and tent to the ground at a predetermined location. The lightweight characteristics of the tent are such that it has insufficient weight to maintain it at a fixed location in the event of heavy winds.

To make the tent more enjoyable and functional, apertures 48 and 50 are formed in the tent above the mattress. Some of the apertures function as windows and others as doors. In association with the apertures are closures in the form of windows 52 and doors 54 which function to selectively seal the apertures for providing additional protection to the person or persons within the tent.

The last component of the system is a carrying bag 58. Note FIG. 6. The carrying bag is of a generally conventional construction with a handle 60. The carrying bag is adapted to receive the tent and mattress when in a collapsed and folded orientation.

The present invention is a tent adapted for use in camping. It is a self inflating structure and requires no supporting poles. Pins will be pushed through flaps extending from the base and into the ground in order for the structure to be anchored securely.

The structure is composed of an inner nylon lining, an exterior nylon shell and a core between these of open celled foam. This will apply to the floor of the tent creating a built-in mattress as well as the body of the structure.

When valves are opened, the foam core automatically draws in air and expands. As the foam expands, the structure takes on its functional form. Additional air from the user's mouth or some other device will then be used to fill the core area to its required pressure if necessary or desired.

The mattress section will be separated from the body of the tent and possesses its own air valve so that a required density for sleeping can be achieved without concern for the integrity of the canopy or body of the structure.

When the desired inflation pressure has been achieved, the valves are closed prohibiting any air from escaping.

When deflation is desired, the valves are reopened. After the initial decrease in pressure has occured, the remaining air is then rolled out of the tent manually. This process compresses the foam. When deflation is complete the valves are closed and the rolled up structure is packed in a casing.

Because the inner wall of the structure is separated from the outer wall by a foam core the risk of water leaking into the tent is not a concern. The camper or other user is at liberty to touch the interior and exterior walls of the tent without any risk of water leakage.

Windows in this structure are designed to deter moisture from entering into the tent also. As seen in the sketches enclosed, the external portion of the window is slightly larger and is positioned slightly below the interior portion of the window.

If water were to go beyond the exterior shell of the structure where the window opening is placed, it would meet the sloping ledge covering the foam core before it reached the interior opening. The water would then slide out and down the exterior wall. If water, or any liquid, were to spill into the interior it could be easily dried with a cloth. The bonding compound used to adhere the nylon shells to the foam core would deter moisture from entering into the core if the nylon were saturated. This event would be unlikely if a coated nylon is used.

While the preferred embodiment is shown as a dome, it should be understood that other configurations could be utilized, as for example a semi-cylindrical tube like structure. Larger embodiments of either configuration could by used for two to four persons or more. Smaller embodiments could be used for one or two persons.

When deflated and packed, each structure is a fraction of its weight and size when inflated.

The Dome is designed as a seamless structure or it could be seamed as with six wall panels. It holds two windows and one entrance. One of these features will be located on every second panel. The tubular embodiment is designed with two entrances, one on each end. Window openings along the length of the structure have not been incorporated into this design at this time.

Significant design features include:

1) No supporting poles.

2) Minimal weight and size when packed.

3) Compact for travelling in any mode of transportation.

4) Can be installed and packed away at any time of night or day with minimal effort.

5) Ease of deflation, and inflation can be achieved by people who might have difficulty with other kinds of camping tents, e.g. elderly, children, handicapped, etc.

6) Waterproof.

7) Increased mobility within structure.

8) Structure will not necessarily need to be deflated to be moved to a new location within walking distance.

9) Structure will not need to be deflated to be repositioned at an existing location.

10) A camper could do other activities while the structure, for the most part inflates and deflates itself.

11) The foam core will act as a thermal barrier, retaining heat in colder temperatures, retaining coolness in warmer temperatures.

12) Built in sleeping mattress, also acts as a thermal barrier from ground temperature. Mattress is one uniform surface for comfort and acts as a buffer against ground alterations, and debris and it also has a waterproof floor.

13) The interior will be shaded largely from the sun because of layered walls.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved self-inflating tent comprising, in combination:

a mattress having a top and bottom side of a circular configuration, the bottom side having a circular sheet attached thereto having a diameter larger than a diameter of the mattress;

a dome shaped tent having a lower peripheral edge secured to the mattress adjacent to the bottom side providing a flange at an outer most periphery of the tent to constitute a ground rim;

the material of the tent and mattress being fabricated of an open cell polyurethane capable of unaided air expansion, the open cell polyurethane being enclosed by an exterior and interior liner of an air impervious flexible plastic;

a first valve coupled to the tent to allow the flow of air into the open cells of the tent material and to expand the tent material, the first valve also allowing air to exit therefrom the tent material when the tent material is compressed and the first valve is opened;

a second valve coupled to the mattress and passing through the lower peripherial edge of the tent to allow flow of air into the mattress material the second value also allowing air to exit therefrom the mattress material when the mattress material is compressed and the second valve is opened;

a plurality of grommets extending though the ground rim securing the mattress and tent in a predetermined location;

apertures formed in the tent, said apertures having windows and doors located therein; and a carrying bag for receiving the tent and mattress when in a collapsed and folded orientation.

* * * * *